US007823757B1

(12) United States Patent
Vinson et al.

(10) Patent No.: US 7,823,757 B1
(45) Date of Patent: Nov. 2, 2010

(54) SPILL CONTAINMENT SYSTEM

(76) Inventors: Willis W. Vinson, 527 County Road 310, Palatka, FL (US) 32177; Randall Vinson, 527 County Road 310, Palatka, FL (US) 32177

( * ) Notice: Subject to any disclaimer, the term of this patent is extended or adjusted under 35 U.S.C. 154(b) by 567 days.

(21) Appl. No.: 11/850,758

(22) Filed: Sep. 6, 2007

(51) Int. Cl.
*B60P 3/22* (2006.01)

(52) U.S. Cl. ..... 222/608; 222/162; 222/181.1; 222/185.1; 222/235; 222/505; 222/623; 222/625; 239/685

(58) Field of Classification Search ..... 222/608, 222/614, 619–620, 623–625, 162, 181.1, 222/472–474, 502, 559, 185.1, 192, 235, 222/505, 617, 611.1, 613; 239/650–652, 239/664–665, 681, 683, 676, 685
See application file for complete search history.

(56) References Cited

U.S. PATENT DOCUMENTS 802,342 A * 10/1905 Whitley ..... 222/619
1,157,370 A * 10/1915 Cox ..... 222/619
1,562,002 A * 11/1925 Rieff ..... 222/287
3,310,314 A * 3/1967 Bylsma et al. ..... 239/683
3,907,212 A 9/1975 Ullom
4,029,237 A * 6/1977 Miconi ..... 222/614
4,121,733 A 10/1978 McRoskey et al.
4,402,438 A 9/1983 Gregory
4,440,410 A * 4/1984 Bradshaw ..... 280/47.26
4,588,133 A * 5/1986 Brabb et al. ..... 239/681
D284,666 S 7/1986 Amerine
4,681,265 A * 7/1987 Brabb et al. ..... 239/665
5,273,298 A * 12/1993 Brown, Sr. ..... 280/47.19
5,288,017 A 2/1994 Halovitz
5,607,079 A 3/1997 DeLaby et al.
5,846,334 A 12/1998 Hoce
6,138,927 A * 10/2000 Spear et al. ..... 239/666
6,189,802 B1 2/2001 Holton
7,270,251 B1 * 9/2007 Robinson ..... 222/608

* cited by examiner

*Primary Examiner*—Frederick C. Nicolas

(57) ABSTRACT

A spill containment system for dispensing a berm of containment material on a support surface around a liquid spill to inhibit the liquid spill from spreading across the support surface includes a container receiving the containment material. The container includes a bottom wall and a perimeter wall that extends upwardly from the bottom wall to define an interior space of the container. A dispensing assembly is coupled to the container. The dispensing assembly is actuated to dispense the containment material from the container. The dispensing assembly controls flow of the containment material through a dispensing aperture that extends through a rear wall of the perimeter wall.

19 Claims, 6 Drawing Sheets

SPILL CONTAINMENT SYSTEM

BACKGROUND OF THE INVENTION

1. Field of the Invention

The present invention relates to spreaders and more particularly pertains to a new spreader for dispensing a berm of containment material on a support surface around a liquid spill to inhibit the liquid spill from spreading across the support surface.

2. Description of the Prior Art

The use of spreaders is known in the prior art. While these devices fulfill their respective, particular objectives and requirements, the need remains for a system that has certain improved features to dispense a containment material in a berm around a liquid spill to contain the liquid spill in an area surrounded by the berm. Additionally, the system should include a plurality of slots in a latching plate a dispensing assembly to allow the containment material to be dispensed at varying rates from the system.

SUMMARY OF THE INVENTION

The present invention meets the needs presented above by generally comprising a container receiving the containment material. The container includes a bottom wall and a perimeter wall that extends upwardly from the bottom wall to define an interior space of the container. A dispensing assembly is coupled to the container. The dispensing assembly is actuated to dispense the containment material from the container. The dispensing assembly controls flow of the containment material through a dispensing aperture that extends through a rear wall of the perimeter wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
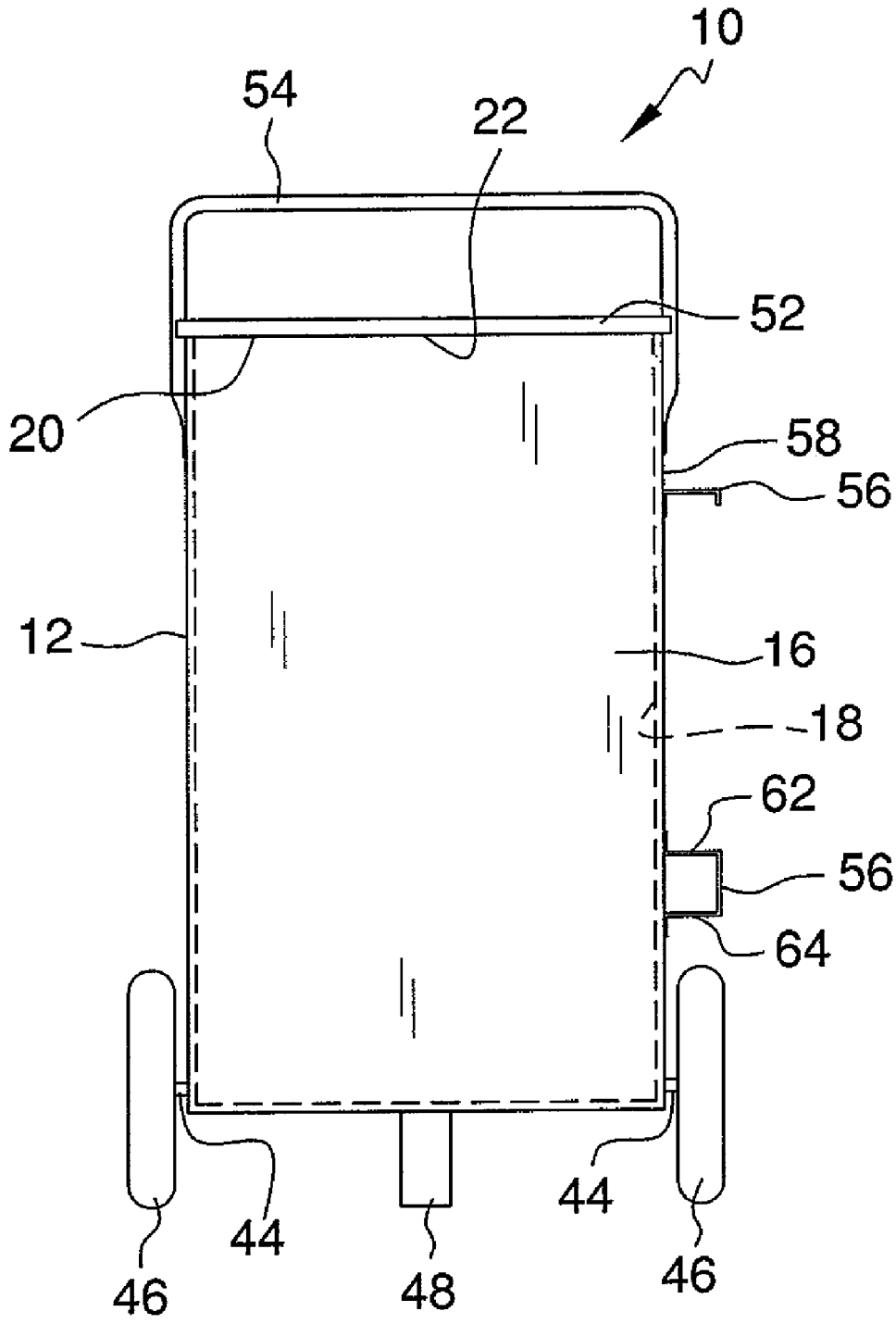
FIG. 1 is a front view of a spill containment system according to the present invention.
Figure 2:
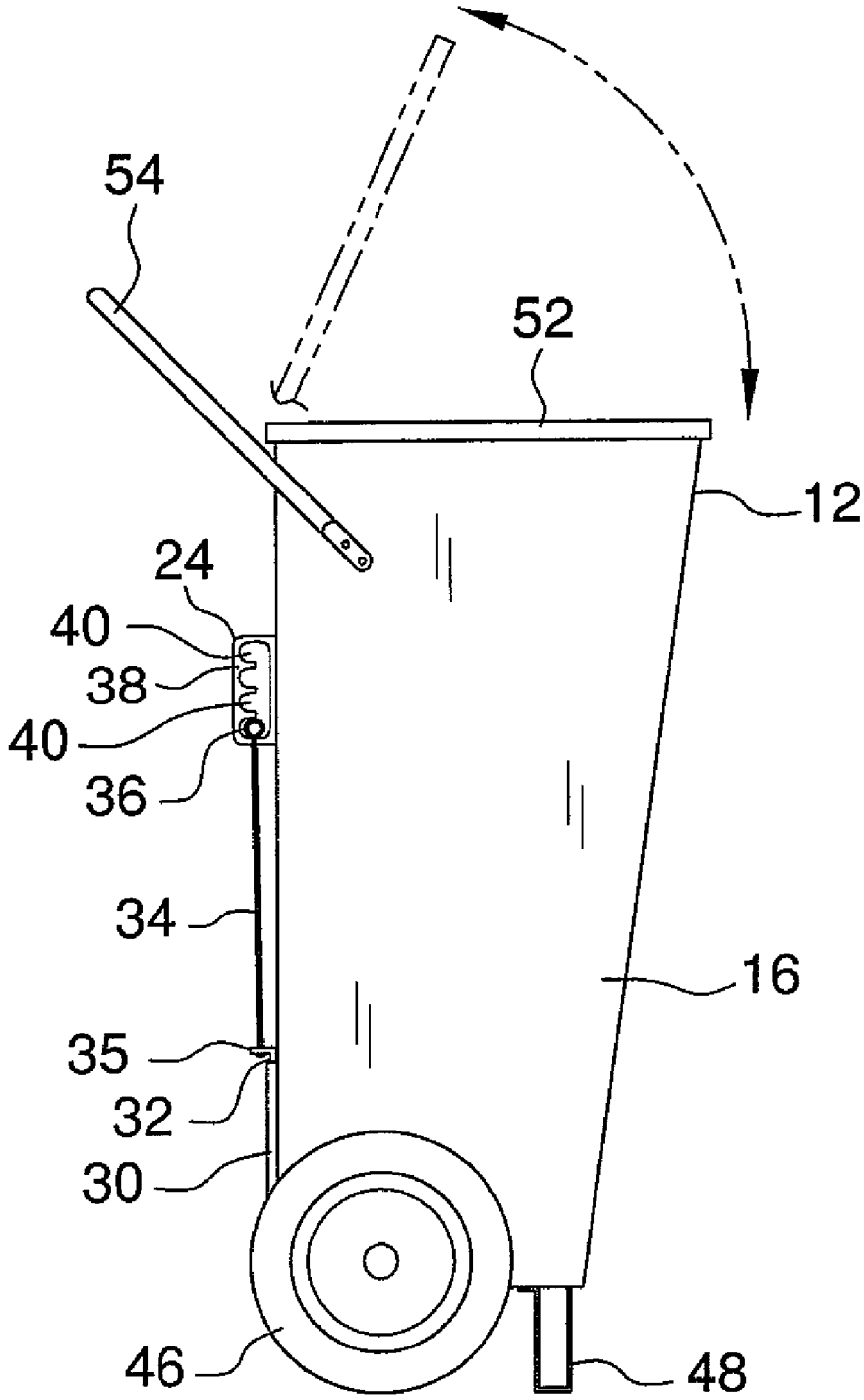
FIG. 2 is a left side view of the present invention.
Figure 3:
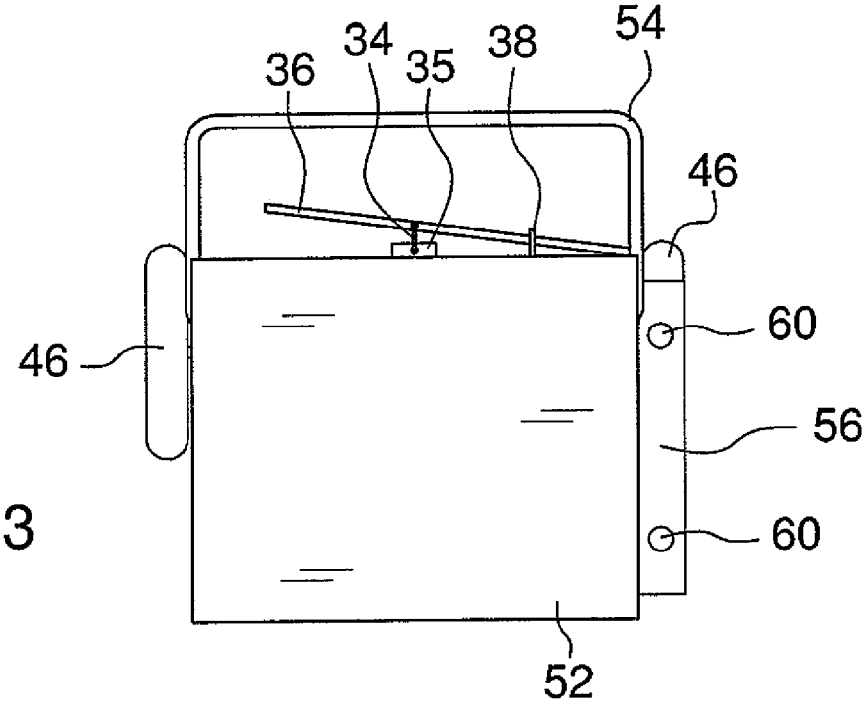
FIG. 3 is a top view of the present invention.
Figure 4:
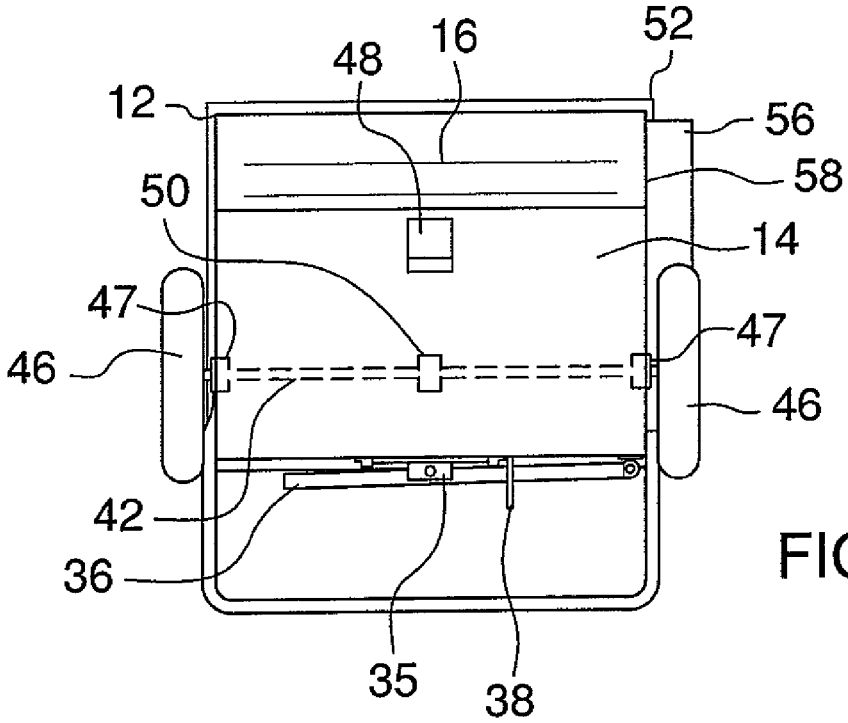
FIG. 4 is a bottom view of the present invention.
Figure 5:
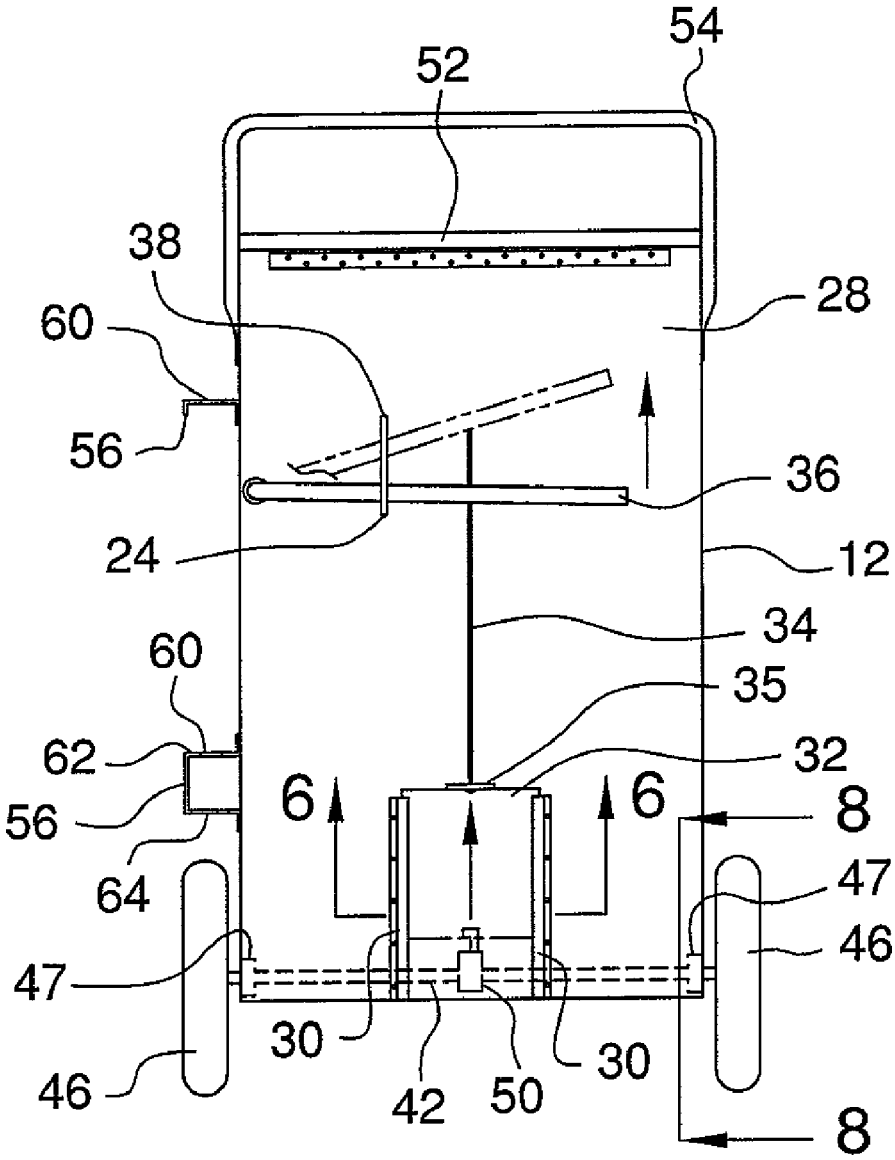
FIG. 5 is a rear view of the present invention.
Figure 6:
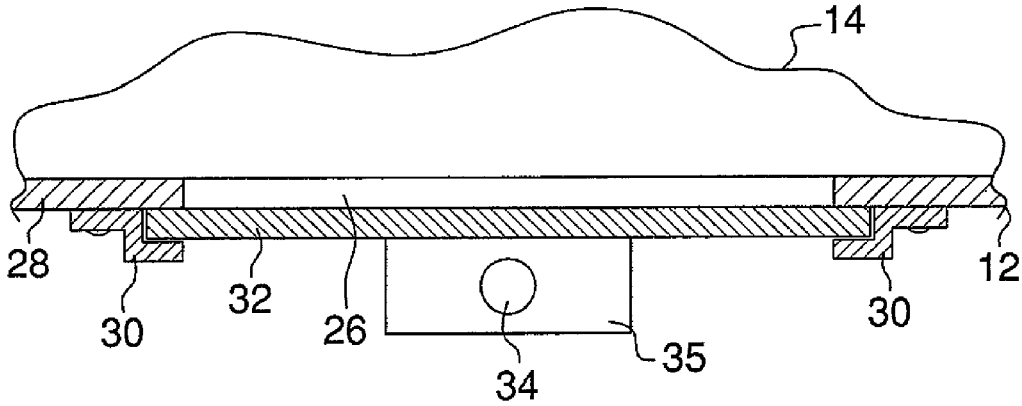
FIG. 6 is a cross-sectional view of the present invention taken along line 6-6 of FIG. 5.
Figure 7:
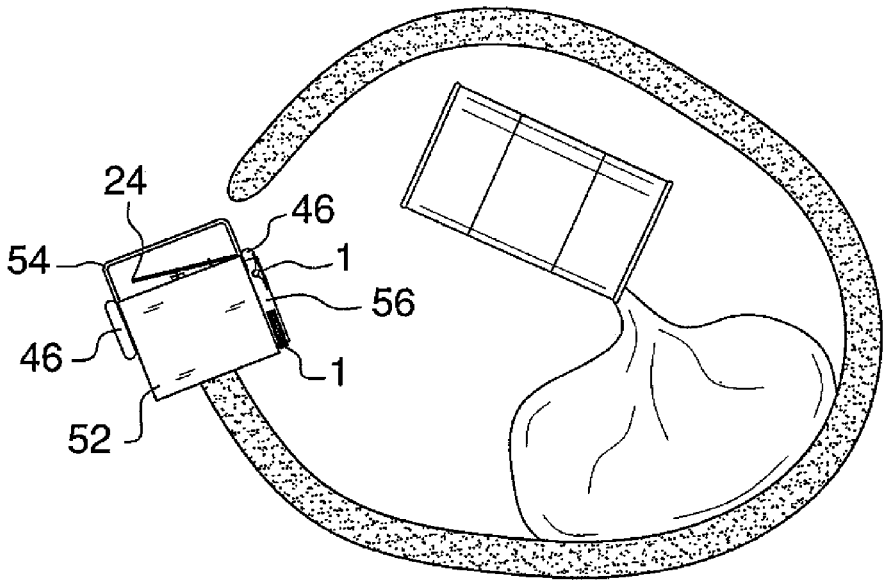
FIG. 7 is a top view of the present invention shown in use.
Figure 8:
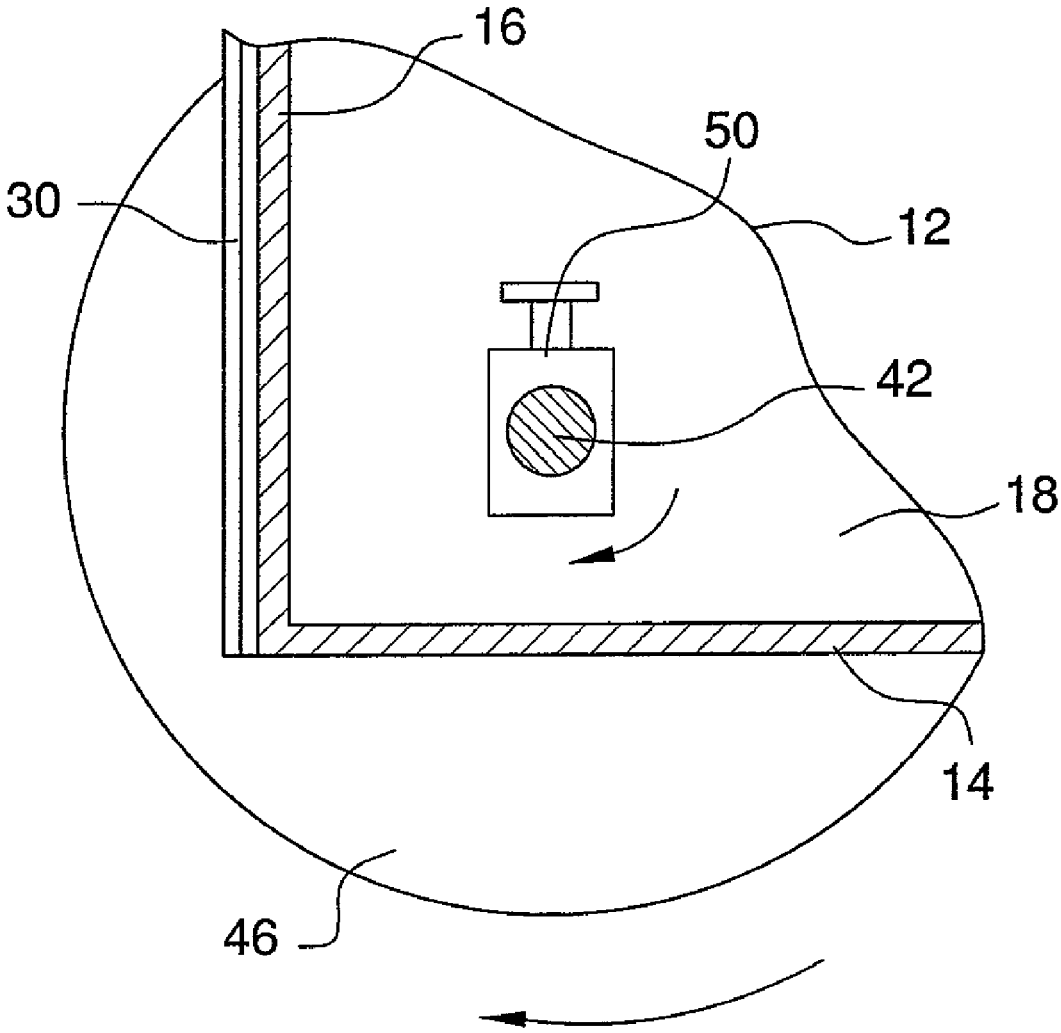
FIG. 8 is a cross-sectional view of the present invention taken along line 8-8 of FIG. 5.

With reference now to the drawings, and in particular to FIGS. 1 through 8 thereof, a new spreader embodying the principles and concepts of the present invention and generally designated by the reference numeral 10 will be described.

As best illustrated in FIGS. 1 through 8, the spill containment system 10 generally comprises a container 12 receiving a containment material. The container 12 includes a bottom wall 14 and a perimeter wall 16 that extends upwardly from the bottom wall 14 to define an interior space 18 of the container 12. An upper edge 20 of the perimeter wall 16 defines an open top end 22 of the container 12. The open top end 22 permits the containment material to be inserted into the interior space 18 of the container 12. The container 12 has a height of approximately 30 inches, a width of approximately 18 inches and a depth between approximately 16 inches and approximately 29 inches.

A dispensing assembly 24 is coupled to the container 12. The dispensing assembly 24 is actuated to dispense the containment material from the container 12. The dispensing assembly 24 controls flow of the containment material through a dispensing aperture 26 that extends through a rear wall 28 of the perimeter wall 16. The dispensing aperture 26 has height of approximately 4 inches and width of approximately 2⅜ inches. The dispensing assembly 24 includes a pair of rails 30 coupled to the container 12. The dispensing aperture 26 is positioned between the rails 30.

The dispensing assembly 24 also includes a gate 32 slidably positioned between the rails 30. The gate 32 is positioned over the dispensing aperture 26 to close the dispensing aperture 26 when the gate 32 is positioned in a lowered position. The gate 32 is slid upwardly from the lowered position to open the dispensing aperture 26 and allow the containment material to be dispensed through the dispensing aperture 26. A lifting bar 34 is coupled to the gate 32. The lifting bar 34 slides the gate 32 with respect to the rails 30 when the lifting bar 34 is raised and lowered. A lever 36 is pivotally coupled to the container 12. The lifting bar 34 may be coupled to a tab 35 of the gate 32 that extends away from the container 12. The lever 36 is coupled to the lifting bar 34. The lever 36 raises and lowers the lifting bar 34 when the lever 36 is pivoted with respect to the container 12.

The dispensing assembly 24 additionally includes a latching plate 38 coupled to and outwardly extends from the container 12. The latching plate 38 has a plurality of slots 40 that extend therethrough. The slots 40 are vertically aligned along the latching plate 38. The lever 36 extends through and is movable between the slots 40 when the lever 36 is pivoted. The lever 36 is positioned in a lower most one of the slots 40 to position the gate 32 over the dispensing aperture 26 to close the dispensing aperture 26. The lever 36 is positioned in an upper most one of the slots 40 to slide the gate 32 upwardly and expose the dispensing aperture 26 to dispense the greatest amount of containment material.

An axle 42 is rotatably coupled to and extends through the container 12. Each of a pair of opposing ends 44 of the axle 42 has one of a pair wheels 46 coupled thereto. The wheels 46 are rolled along a support surface to allow the containment material to be dispensed from the dispensing aperture 26 to form a berm around a liquid spill on the support surface. A pair of bearings 47 is coupled to the container 12 and the axle 42 passes through the bearings 47. The bearings 47 help to maintain smooth rotation of the axle 42 and inhibit the containment material leaking out between the container 12 and the axle 42. The wheels 46 have a diameter of approximately 10 inches. A stand 48 is coupled to and downwardly extends from the container 12. The stand 48 is abutted against the support surface to support the container 12 on the stand 48 and the wheels 46 when the container 12 is not being transported across the support surface.

An agitator 50 is coupled to the axle 42 and positioned between the wheels 46. The agitator 50 is positioned adjacent to the dispensing aperture 26. The agitator 50 is rotated within the interior space 18 to break up the containment material adjacent to the dispensing aperture 26 when the wheels 46 are rolled along the support surface.

A lid 52 is hingedly coupled to the perimeter wall 16. The lid 52 is positionable over the open top end 22 of the container 12 to selectively close the open top end 22. A handle 54 is coupled to the container 12. The handle 54 is graspable to facilitate manipulation of the container 12 across the support surface.

A pair of brackets 56 is coupled to the container 12 and positioned on a side face 58 thereof. Each of the brackets 56 has a plurality of tool apertures 60 that extend therethrough. Each of the tool apertures 60 of one of the brackets 56 is vertically aligned with one of the tool apertures 60 of the other one of the brackets 56. The tool apertures 60 receive tools 1 to support the tools 1 from the container 12. A lower most one of the brackets 56 is approximately U-shaped. An upper plate 62 of the lower most one of the brackets 56 has the tool apertures 60 extending therethrough to allow the tools 1 to extend into the associated one of the brackets 56 rest upon a lower plate 64 of the associated one of the brackets 56.

In use, the containment material is placed into the interior space 18 of the container 12. The lever 36 is pivoted upwardly to raise the gate 32 and allow the containment material to flow out of the dispensing aperture 26. The container 12 is then rolled along the support surface on the wheels 46 to form a berm of the containment material on the support surface around the spilled liquid to inhibit spreading of the spilled liquid across the support surface. As the wheels 46 roll along the support surface the axle 42 is rotated and the agitator 50 is rotated as well to break up any clumps that may have formed in the containment material to facilitate an even flow of the containment material from the dispensing aperture 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A spill containment system for dispensing a containment material, said system comprising:

a container receiving the containment material, said container including a bottom wall and a perimeter wall extending upwardly from said bottom wall to define an interior space of said container; and a dispensing assembly being coupled to said container, said dispensing assembly being actuated to dispense the containment material from said container, said dispensing assembly controlling flow of the containment material through a dispensing aperture extending through a rear wall of said perimeter wall, said dispensing assembly including;

a pair of rails being coupled to said container, said dispensing aperture being positioned between said rails;

a gate being slidably positioned between said rails, said gate being positioned over said dispensing aperture to close said dispensing aperture when said gate is positioned in a lowered position, said gate being slid upwardly from said lowered position to open said dispensing aperture and allow the containment material to be dispensed through said dispensing aperture;

a lifting bar being coupled to said gate, said lifting bar sliding said gate with respect to said rails when said lifting bar is raised and lowered; and a lever being pivotally coupled to said container, said lever being coupled to said lifting bar, said lever raising and lowering said lifting bar when said lever is pivoted with respect to said container.

2. The system according to claim 1, wherein an upper edge of said perimeter wall defines an open top end of said container, said open top end permitting the containment material to be inserted into said interior space of said container.

3. The system according to claim 1, wherein said dispensing assembly includes a latching plate being coupled to and outwardly extending from said container, said latching plate having a plurality of slots extending therethrough, said slots being vertically aligned along a said latching plate, said lever extending through and being movable between said slots when said lever is pivoted.

4. The system according to claim 3, wherein said lever is positioned in a lower most one of said slots to position said gate over said dispensing aperture to close said dispensing aperture, said lever being positioned in an upper most one of said slots to slide said gate upwardly and expose said dispensing aperture to dispense the greatest amount of containment material.

5. The system according to claim 1, further comprising an axle being rotatably coupled to and extending through said container.

6. The system according to claim 5, further comprising a pair of wheels, each of a pair of opposing ends of said axle having one of said wheels coupled thereto, said wheels being rolled along a support surface to allow the containment material to be dispensed from said dispensing aperture to form a berm around a liquid spill on the support surface.

7. The system according to claim 6, further comprising a stand being coupled to and downwardly extending from said container, said stand being abutted against the support surface to support said container on said stand and said wheels when said container is not being transported across the support surface.

8. The system according to claim 6, further comprising an agitator being coupled to said axle and positioned between said wheels, said agitator being positioned adjacent to said dispensing aperture, said agitator being rotated within said interior space to break up the containment material adjacent to said dispensing aperture when said wheels are rolled along the support surface.

9. The system according to claim 1, further comprising a lid being hingedly coupled to said perimeter wall, said lid being positionable over said open top end of said container to selectively close said open top end.

10. The system according to claim 1, further comprising a handle being coupled to said container, said handle being graspable to facilitate manipulation of said container across the support surface.

11. The system according to claim 1, further comprising a pair of brackets being coupled to said container, said brackets being coupled to a side face of said container, each of said brackets having a plurality of tool apertures extending therethrough, each of said tool apertures of one of said brackets being vertically aligned with one of said tool apertures of the other one of said brackets, said tool apertures receiving tools to support the tools from the container.

12. A spill containment system for dispensing a containment material, said system comprising:

a container receiving the containment material, said container including a bottom wall and a perimeter wall extending upwardly from said bottom wall to define an interior space of said container, an upper edge of said perimeter wall defining an open top end of said container, said open top end permitting the containment material to be inserted into said interior space of said container;

a dispensing assembly being coupled to said container, said dispensing assembly being actuated to dispense the containment material from said container, said dispensing assembly controlling flow of the containment material through a dispensing aperture extending through a rear wall of said perimeter wall, said dispensing assembly comprising;

a pair of rails being coupled to said container, said dispensing aperture being positioned between said rails;

a gate being slidably positioned between said rails, said gate being positioned over said dispensing aperture to close said dispensing aperture when said gate is positioned in a lowered position, said gate being slid upwardly from said lowered position to open said dispensing aperture and allow the containment material to be dispensed through said dispensing aperture;

a lifting bar being coupled to said gate, said lifting bar sliding said gate with respect to said rails when said lifting bar is raised and lowered;

a lever being pivotally coupled to said container, said lever being coupled to said lifting bar, said lever raising and lowering said lifting bar when said lever is pivoted with respect to said container;

a latching plate being coupled to and outwardly extending from said container, said latching plate having a plurality of slots extending therethrough, said slots being vertically aligned along a said latching plate, said lever extending through and being movable between said slots when said lever is pivoted, said lever being positioned in a lower most one of said slots to position said gate over said dispensing aperture to close said dispensing aperture, said lever being positioned in an upper most one of said slots to slide said gate upwardly and expose said dispensing aperture to dispense the greatest amount of containment material;

an axle being rotatably coupled to and extending through said container;

a pair of wheels, each of a pair of opposing ends of said axle having one of said wheels coupled thereto, said wheels being rolled along a support surface to allow the containment material to be dispensed from said dispensing aperture to form a berm around a liquid spill on the support surface;

a stand being coupled to and downwardly extending from said container, said stand being abutted against the support surface to support said container on said stand and said wheels when said container is not being transported across the support surface; and an agitator being coupled to said axle and positioned between said wheels, said agitator being positioned adjacent to said dispensing aperture, said agitator being rotated within said interior space to break up the containment material adjacent to said dispensing aperture when said wheels are rolled along the support surface.

13. A spill containment system for dispensing a containment material, said system comprising:

a container receiving the containment material, said container including a bottom wall and a perimeter wall extending upwardly from said bottom wall to define an interior space of said container; and a dispensing assembly being coupled to said container, said dispensing assembly being actuated to dispense the containment material from said container, said dispensing assembly controlling flow of the containment material through a dispensing aperture extending through a rear wall of said perimeter wall;

an axle being rotatably coupled to and extending through said container;

a pair of wheels, each of a pair of opposing ends of said axle having one of said wheels coupled thereto, said wheels being rolled along a support surface to allow the containment material to be dispensed from said dispensing aperture to form a berm around a liquid spill on the support surface.

14. The system according to claim 13, wherein said dispensing assembly includes a pair of rails being coupled to said container, said dispensing aperture being positioned between said rails.

15. The system according to claim 14, wherein said dispensing assembly includes a gate being slidably positioned between said rails, said gate being positioned over said dispensing aperture to close said dispensing aperture when said gate is positioned in a lowered position, said gate being slid upwardly from said lowered position to open said dispensing aperture and allow the containment material to be dispensed through said dispensing aperture.

16. The system according to claim 13, wherein said dispensing assembly includes;

a lifting bar being coupled to said gate, said lifting bar sliding said gate with respect to said rails when said lifting bar is raised and lowered;

a lever being pivotally coupled to said container, said lever being coupled to said lifting bar, said lever raising and lowering said lifting bar when said lever is pivoted with respect to said container;

a latching plate being coupled to and outwardly extending from said container, said latching plate having a plurality of slots extending therethrough, said slots being vertically aligned along a said latching plate, said lever extending through and being movable between said slots when said lever is pivoted, wherein said lever is positioned in a lower most one of said slots to position said gate over said dispensing aperture to close said dispensing aperture, said lever being positioned in an upper most one of said slots to slide said gate upwardly and expose said dispensing aperture to dispense the greatest amount of containment material.

17. The system according to claim 13, further comprising a stand being coupled to and downwardly extending from said container, said stand being abutted against the support surface to support said container on said stand and said wheels when said container is not being transported across the support surface.

18. The system according to claim 13, further comprising an agitator being coupled to said axle and positioned between said wheels, said agitator being positioned adjacent to said dispensing aperture, said agitator being rotated within said interior space to break up the containment material adjacent to said dispensing aperture when said wheels are rolled along the support surface.

19. The system according to claim 13, further comprising a pair of brackets being coupled to said container, said brackets being coupled to a side face of said container, each of said brackets having a plurality of tool apertures extending therethrough, each of said tool apertures of one of said brackets being vertically aligned with one of said tool apertures of the other one of said brackets, said tool apertures receiving tools to support the tools from the container.

* * * * *